US007640682B1

(12) United States Patent
Buckbee

(10) Patent No.: US 7,640,682 B1
(45) Date of Patent: Jan. 5, 2010

(54) REMOVABLE AND STORABLE WINGS FOR A SNOW PLOW BLADE AND SNOW REMOVAL SYSTEM USED THEREWITH

(75) Inventor: Mark D. Buckbee, Wauwatosa, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 12/140,893

(22) Filed: Jun. 17, 2008

(51) Int. Cl.
*E01H 5/06* (2006.01)

(52) U.S. Cl. ..... 37/281; 37/266

(58) Field of Classification Search ..... 37/231, 37/232, 266, 272, 274, 279, 281; 172/777, 172/784, 782, 811–817, 827, 828, 832; 414/699, 414/700, 721–725
See application file for complete search history.

(56) References Cited

U.S. PATENT DOCUMENTS

| | | | | |
|---|---|---|---|---|
| 4,145,825 | A | | 3/1979 | Bertolino |
| 4,275,514 | A | | 6/1981 | Maura |
| RE31,045 | E | * | 10/1982 | Essell et al. ..... 37/281 |
| 4,741,116 | A | | 5/1988 | Engle et al. |
| 4,962,600 | A | | 10/1990 | Zellaha et al. |
| 5,148,617 | A | | 9/1992 | Feller et al. |
| 5,638,618 | A | | 6/1997 | Niemela et al. |
| 5,894,689 | A | | 4/1999 | Turk |
| 5,899,007 | A | | 5/1999 | Niemela et al. |
| 6,408,549 | B1 | | 6/2002 | Quenzi et al. |
| 6,412,199 | B1 | | 7/2002 | Quenzi et al. |
| 6,442,877 | B1 | | 9/2002 | Quenzi et al. |
| 7,134,227 | B2 | | 11/2006 | Quenzi et al. |
| 2007/0068049 | A1 | | 3/2007 | Quenzi et al. |

* cited by examiner

*Primary Examiner*—Robert E Pezzuto
(74) *Attorney, Agent, or Firm*—Reinhart Boerner Van Deuren s.c.

(57) ABSTRACT

Removable wings or end extensions for a snow plow blade and a snow removal system including removable end extensions are provided. Each of the removable end extensions secure to a side end of a snow plow blade, and are easily removed and stored on the snow plow blade, when not required for the plowing application.

19 Claims, 12 Drawing Sheets

REMOVABLE AND STORABLE WINGS FOR A SNOW PLOW BLADE AND SNOW REMOVAL SYSTEM USED THEREWITH

IDENTIFICATION OF RELATED PATENT APPLICATIONS

This patent application is related to co-pending and concurrently filed U.S. patent application Ser. No. 12/140,886, entitled "Snow Plow Blade Including Nut Retaining Plate" which is assigned to the assignee of the present application, and which patent application is hereby incorporated herein by reference in its entirety.

BACKGROUND OF THE INVENTION

Field of the Invention

The present invention relates generally to snow plow blades, and particularly to removable wings or end extensions for snow plow blades used with a snow removal system.

To move and remove snow and other road debris, a snow plow must be designed to withstand vibration, debris and heavy snow impact, exposure to salt and UV radiation and other rugged environmental conditions over its operating lifetime. Snow plow vehicles depend on the particular plowing application, and can include medium or light duty trucks, a skid or front-end loaders or commercial/government vehicles. A snow plow blade is mounted to the front of the plowing vehicle and has a generally curvilinear shape, to roll the snow upwardly from the bottom and then move it transversely across the face of the blade.

In its simplest form, a typical snow plow blade includes a support frame, having a substantially arcuate or curved overall cross-section, and a skin or moldboard, also having an arcuate cross-section. The rear side of the snow plow blade is hitched or otherwise attached to the plowing vehicle. The moldboard is secured to the front of the frame and includes a front surface that directly contacts and moves the snow during operation of the snow plow. A wearstrip or cutting edge is also secured to the front side of the frame near the bottom edge of the moldboard, which is the surface that contacts the ground during plowing.

Snow plow blades come in may different types and sizes, depending on the particular plowing application. One type of snow plow design includes a straight, single snow plow blade. This type of blade can be operated in a straight position or can be pivoted left or right about a central axis to push snow to either side of the vehicle. However, a plow with a straight blade has difficulty in pushing a mound of snow to an out of the way location because snow spills out the sides of the plow.

Another type of snow plow design is referred to as an "apex type" plow blade, "articulated plow blade" or a "V-plow" because the hinge is at the apex of the V formed when the wings or blades of the plow are in a swept back position). The snow plow blades of a V-plow can be individually positioned into any configuration—allowing the snow to be pushed to either side of the snow plow. Like a straight blade design, an articulated snow plow has a difficult time moving large mounds of snow because snow tends to spill over the far ends of each of the wing blades.

In order to improve the efficiency of a snow plow system, providing an end extension to increase the width or plowing productivity of a snow plow blade have been attempted. Prior art end extensions for snow plow blades typically require a significant amount of effort and mechanical modification, such as drilling or welding of the blade frame, to safely and securely mount an end extension to a snow plow blade. As such, prior art end extensions, if provided, are constructed to be permanent/semi-permanent additions to the snow plow blade. If the end extensions are removed for a given application, the extensions are stored apart from the snow plow blade, making a quick change to an extended blade inconvenient and time consuming.

SUMMARY OF THE INVENTION

The disadvantages and limitations of the background art discussed above are overcome by the present invention. With this invention, a snow removal system including a snow plow blade and removably securable and storable end extensions are provided.

The snow plow blade has a front, plowing side, and a rear side that will be secured to the plow vehicle. In its simplest form, the snow plow blade includes a support frame having a substantially arcuate overall cross-section, a moldboard and a cutting edge or wearstrip secured near the bottom of the support frame. The snow plow blade is configured to receive and store first and second removable wing extensions.

A bottom member of the support frame is constructed of a three sided channel member including a channel top, and front and rear legs which angle downward and outward from the channel top. The front leg of the bottom frame member includes a plurality of evenly spaced apertures for mounting the wearstrip when the snow plow blade is assembled. A nut holder or retaining bar is secured to the inside surface of the front leg. The nut retaining bar includes also plurality of apertures formed therein, which are spaced to substantially axially align with the apertures formed in the front leg of the bottom frame member of the snow plow blade.

The apertures in the nut retaining bar are preferably oval or oblong in shape, and are sized to accommodate a hex nut. Importantly, each aperture in the nut retaining bar is sized to receive at least a portion of the nut but is not large enough for the nut to be turned in either a clockwise or counterclockwise direction once positioned inside the aperture, preventing movement of the nut therein.

Accordingly, when the support frame of the snow plow blade is assembled using the nut retaining bar of the present invention, the wearstrip can be bolted to the support frame from the plowing or front side of the support frame. To do this, each bolt used to secure the wearstrip in place is inserted consecutively through an aperture in the wearstrip, a corresponding aperture in the moldboard, a corresponding aperture in the bottom frame member and a corresponding aperture in the nut retaining bar. A nut, which is positioned inside each of the apertures in the nut retaining bar, is then threaded on to the bolt. Because the nut cannot be turned or rotated inside the aperture of the nut retaining bar, each of the bolts can be tightened from the front of the snow plow blade, without the problem of the nut spinning, turning or coming loose, and without the need for a second individual to hold the nut in place during installation and removal of the wearstrip.

The present invention also provides, removable snow plow wing extensions and snow plow blades configured to store and removably secure end extensions to one or both side ends of a snow plow blade. As such, a pair of wing extensions constructed in accordance with the present invention are configured in substantially the same manner; but are mirror images of each other, as will be appreciated by those skilled in the art.

A wing or end extension of the present invention, in its simplest form, includes a wing frame, a moldboard section secured to the front side of the wing frame and a wing cutting edge or wearstrip secured to a bottom edge of the moldboard section. The wing frame comprises a top member provided, at least in part, to retain or secure the top edge of the moldboard section in place, a bottom member provided, at least in part, to retain or secure the moldboard section and/or the wearstrip in place, vertical side members, and an attachment mechanism.

The attachment mechanism includes an attachment bracket configured to mount tubular attachment arms thereto. The attachment arms are sized to be removably received into apertures provided within the rear side of the main snow plow frame when the extensions are in the operational position, and are configured to be retained in a wing storage bracket, also secured to the rear side of the main snow plow frame, when the wing extension is not needed during operation of the snow plow.

The snow plow blade and removable wings of the present invention are of a construction which is both durable and long lasting, and which will require little or no maintenance to be provided by the user throughout its operating lifetime. The snow plow blade and removable wings of the present invention are also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

A snow plow blade 30 including the nut retaining plate and wing extensions taught by the present invention is illustrated in FIGS. 1 through 21 and is described with respect to a straight snow plow blade. The straight snow plow blade 30 is provided as only one example of the type of snow plow blade that can be utilized with the present invention. It will be appreciated that one or more features of the present invention can be incorporated into each wing of an articulated snow plow configuration, or into smaller, single blade designs, such as those used with skid loaders.

Figure 1:
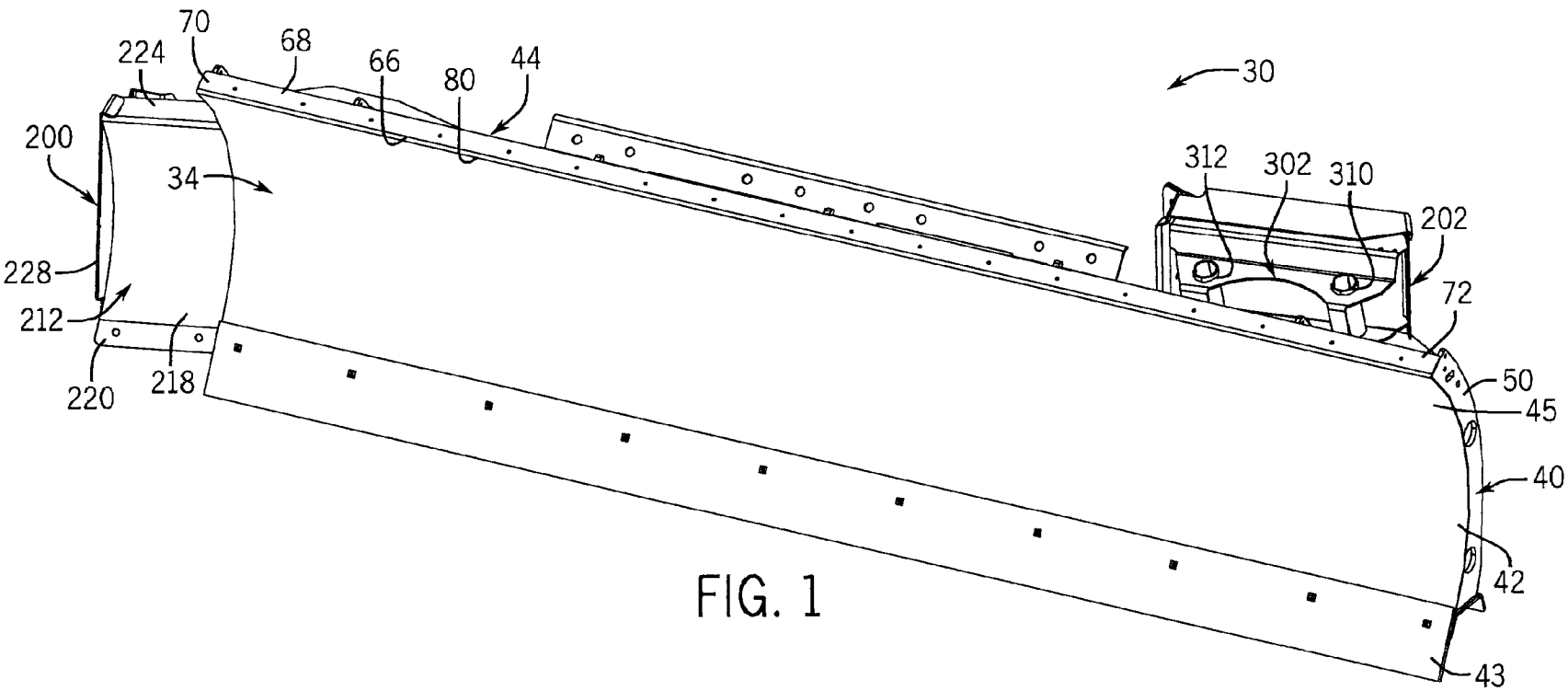
FIG. 1 is a front perspective view of a snow plow blade of the present invention including a first removable wing, shown in the installed position, and a second removable wing, shown in the stored position on the snow plow blade.
Figure 2:
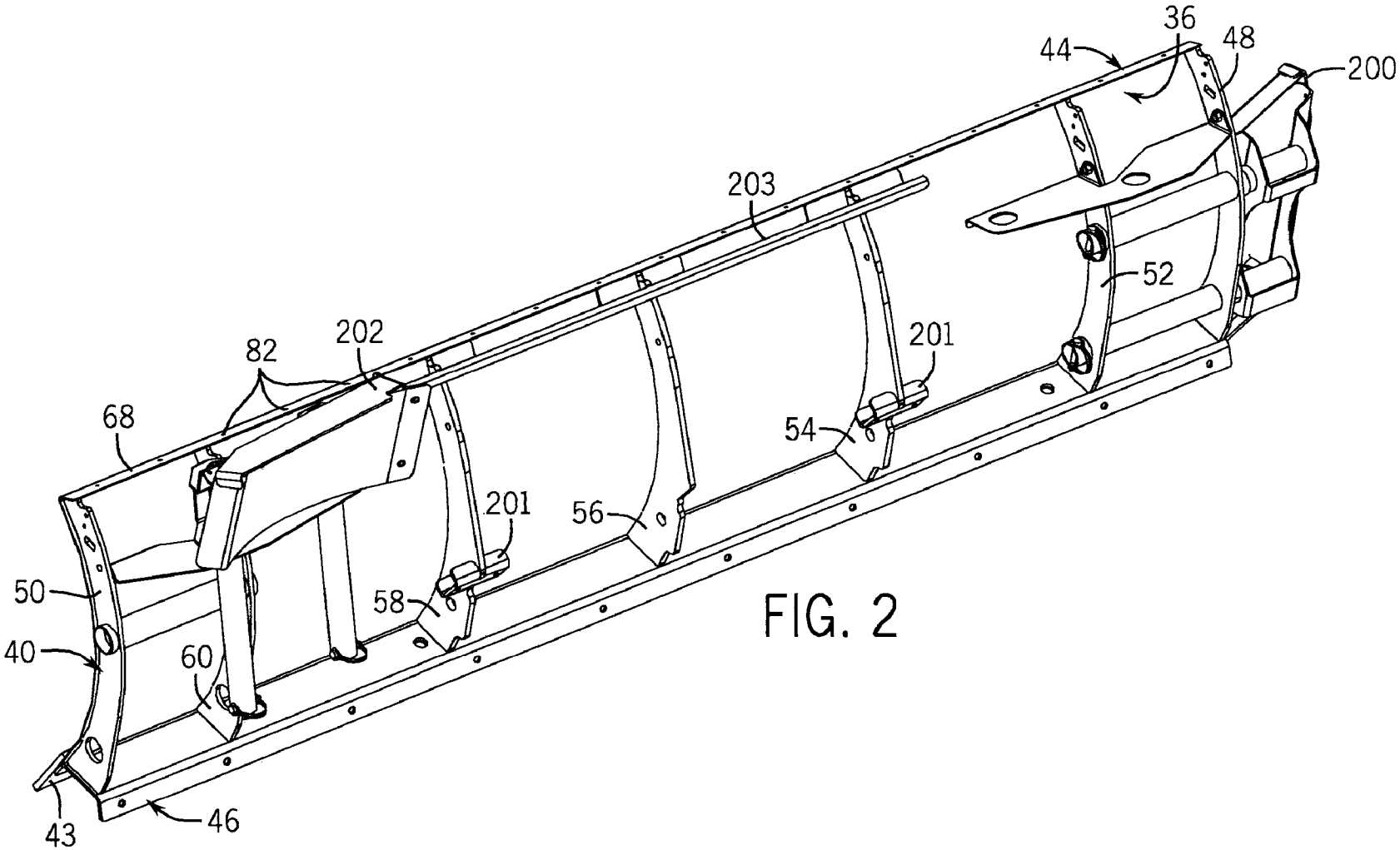
FIG. 2 is a rear perspective view the snow plow blade illustrated in FIG. 1.

Referring first to FIGS. 1 and 2, the snow plow blade 30 has a front, plowing side, indicated generally at 34, and a rear side, indicated generally at 36, that will be secured to the plow vehicle with a hitch mechanism (not shown) during operation of the snow plow. In its simplest form, the snow plow blade 30 of the present invention includes a support frame 40 having a substantially arcuate overall cross-section, an arcuate moldboard 42, and a cutting edge or wearstrip 43 secured near the bottom of the support frame 40. The snow plow blade 30 is configured to receive first and second removable wing extensions 200 and 202, respectively, secured to opposite ends of the support frame 40 of the snow plow blade 30, as will be described in more detail herein.

The support frame 40 comprises a top horizontal member 44, a bottom horizontal member 46 and vertical side or rib members, indicated generally at 48 and 50, that are generally arcuate shape, connecting the top and bottom members 44 and 46 at respective ends thereof. The frame 40 also includes a plurality of support ribs 52, 54, 56, 58 and 60 having a generally arcuate shape, also connecting the top member 44 to the bottom member 46 to reinforce the support frame 40. It will be appreciated that although five ribs are shown in the Figs., any number of reinforcing ribs can be included, depending on the size of the snow plow blade and end-use application of the snow plow.

The support frame 40 is preferably constructed of a metal material, such as steel, aluminum or another lightweight metal, alloy or composite material capable of withstanding the environmental and wear conditions usually encountered when plowing. It will be appreciated that the frame components are preferably welded together or otherwise permanently secured in a conventional manner. Further, the moldboard 42 and the wearstrip 43 can be constructed of a metal material such as rolled steel, stainless steel, carbon steel or another metal composite or alloy material, as well known to those skilled in the art. Further, the moldboard 42 and/or wearstrip may be constructed of a thermoplastic material, such as polycarbonate or polyurethane, if desired.

The top member 44 of the support frame 40 is preferably formed of an angle member including a front surface 66, a top surface 68 and first and second opposing ends 70 and 72. The front surface 66 of the top member 44 is configured to retain a top edge 45 of the moldboard 42. Accordingly, the front surface 66 comprises a clip, retainer plate or other fastening mechanism 80, and/or can include a plurality of apertures or holes (not shown) between the ends 70 and 72 thereof for removably securing the top edge 45 of the moldboard 42 to the support frame 40 with bolts or screws.

The top surface 68 of the top member 44 includes a plurality of apertures or holes 82 positioned between the ends 70 and 72 thereof for mounting additional accessories to the snow plow blade 30, such as a snow deflector. The apertures 82 may be pre-drilled in the top surface 68, or may be provided at the time of installation of the accessory. It will be appreciated that the top member 44 can be a hollow member, a solid member, a channel member, or any type of rigid structure capable securing the moldboard 42 in position at the top of the support frame 40.

As best illustrated in FIGS. 17 through 21, in addition to FIGS. 1 and 2, the bottom member 46 of the support frame 40 is constructed of a three sided channel member resembling a wide inverted "U", having a channel top 90, front and rear legs 92 and 94 which angle downward and outward from the channel top 90. The bottom member 46 also has first and second side ends 96 and 98. A plurality of reinforcing members 100 are evenly spaced along the length of the bottom member 46 between the side ends 96 and 98 thereof. The reinforcing members 100 are mounted to the channel top 90 and span from the front leg 92 to the rear leg 94 and are secured at each respective end thereto.

The rear leg 94 of the bottom horizontal member 46 includes a plurality of apertures 102. The apertures 102 are substantially equally spaced in the longitudinal direction along the rear leg 94 of the bottom horizontal member 46 and are linearly arranged with respect to each other. The apertures 102 are provided for securing a rear scraper (not shown) to the support frame 40 of the snow plow blade 30, if desired. The apertures 102 may be pre-drilled, or may be provided at the time of installation of the rear scraper.

The front leg 92 of the bottom horizontal member 46 includes a plurality of apertures 104. The apertures 104 are substantially equally spaced in the longitudinal direction along the front leg 92 of the bottom horizontal member 44 and are linearly arranged with respect to each other. Preferably, there are ten apertures 104. Each of the apertures 104 has a diameter 106 sized to accept a bolt 108 or other fastening mechanism to secure the moldboard 43 thereto.

Figure 19:
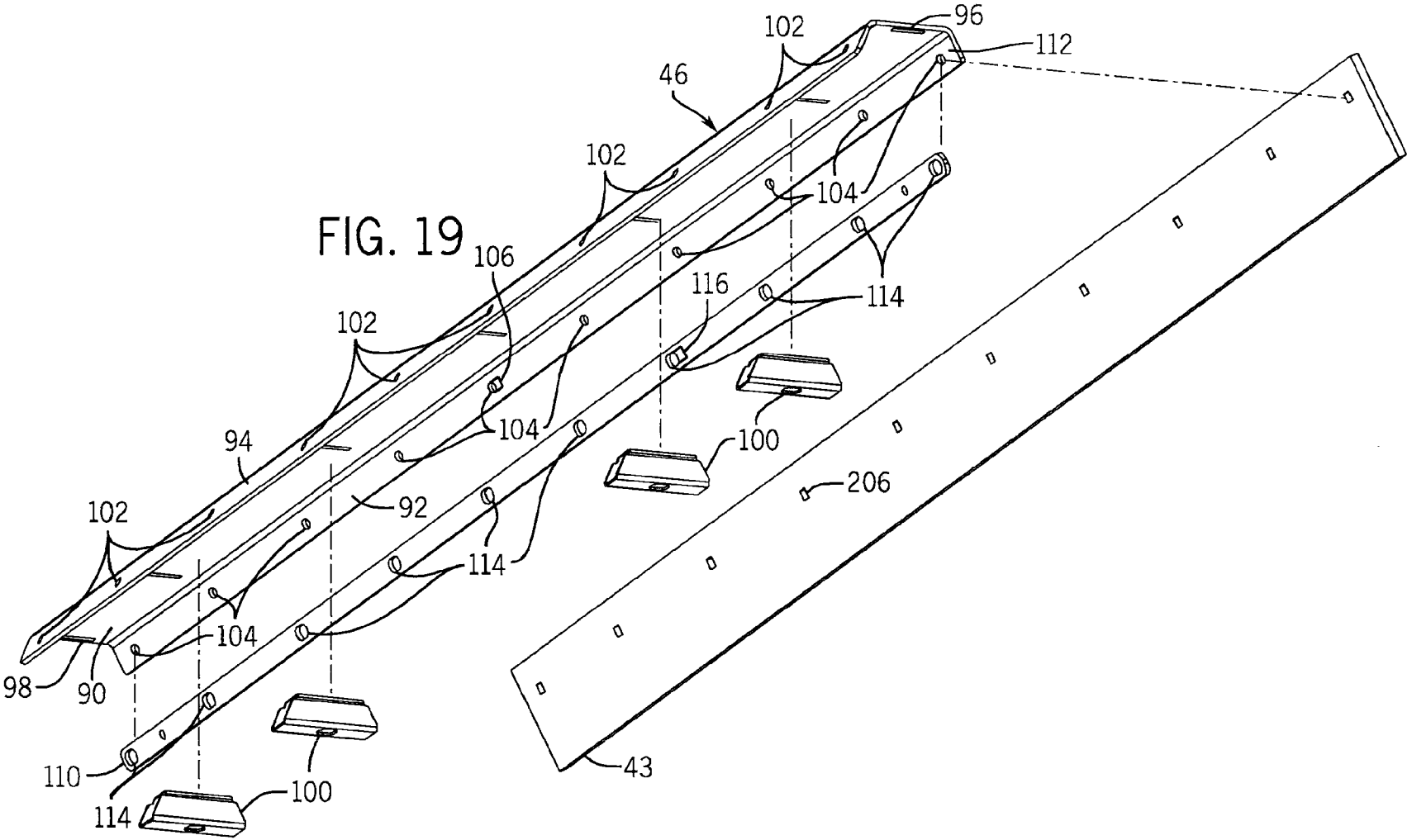
FIG. 19 is an exploded view of a bottom frame member of the snow plow blade illustrated in FIGS. 1 through 11, and 17 and 18.

As best illustrated in FIG. 19, the nut plate or bar 110 is secured to an inside surface 112 of the front leg 92. The nut plate 110 includes a plurality of apertures 114 formed in a substantially equally spaced manner along the length thereof. There are preferably ten apertures 114 in the nut plate 110, spaced to substantially axially align with the apertures 104 in the front leg 92 of the bottom member 46 of the snow plow blade 30.

Figure 18:
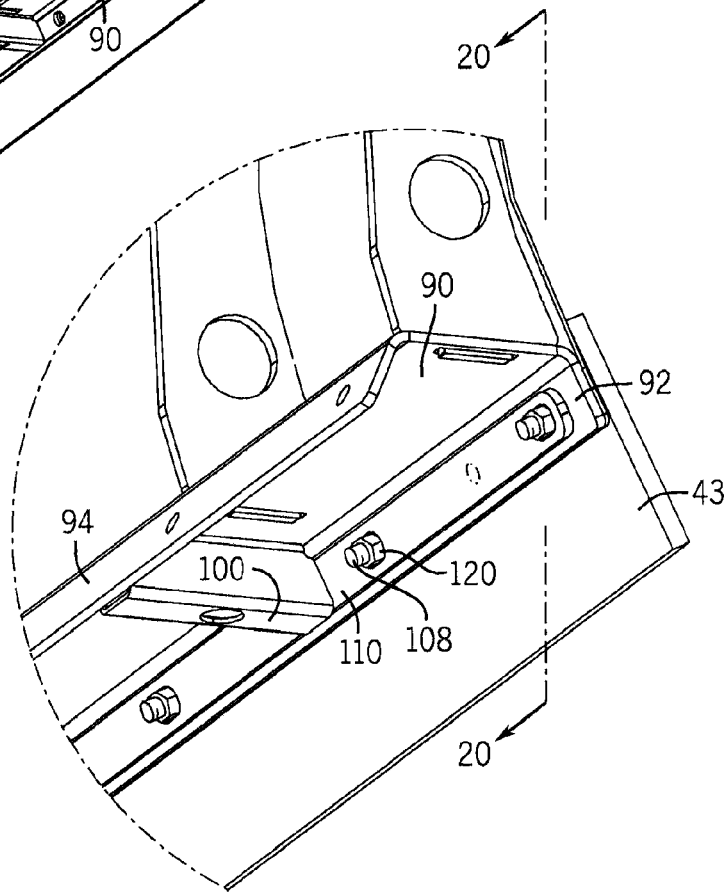
FIG. 18 is partial view of the snow plow blade illustrated in FIGS. 1 through 11 and 17, taken along the line 18-18 in FIG. 17.
Figure 20:
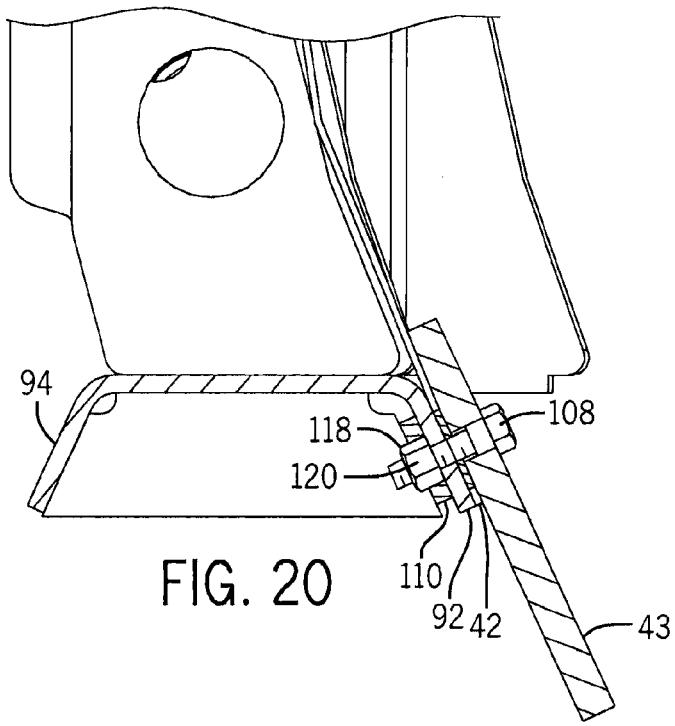
FIG. 20 is a side view of the snow plow blade illustrated FIGS. 1 through 11, and 17 through 19, showing the wearstrip installed on to the frame.

Each aperture 114 has a side wall 115 and is of a diameter 116 larger than the diameter 106 of the apertures 104 on the bottom member 46. Each of the apertures 114 are preferably oval or oblong in shape, and are sized to accommodate a nut 118. Importantly, as illustrated in FIGS. 18 and 20, each aperture 114 is sized to receive the nut 118, but is not large enough for the nut 118 to be turned in either a clockwise or counterclockwise direction once positioned inside the aperture 114, as described in more detail below. As such, at least a portion of the outer edges 120 of the nut 118 contact the side walls 115 of the aperture 114, preventing the movement thereof, when the nut 118 is positioned therein. As illustrated in FIG. 20, it will be appreciated that the apertures 114 are deep enough to accommodate at least a portion of the width 122 of the nut 118.

Figure 3:
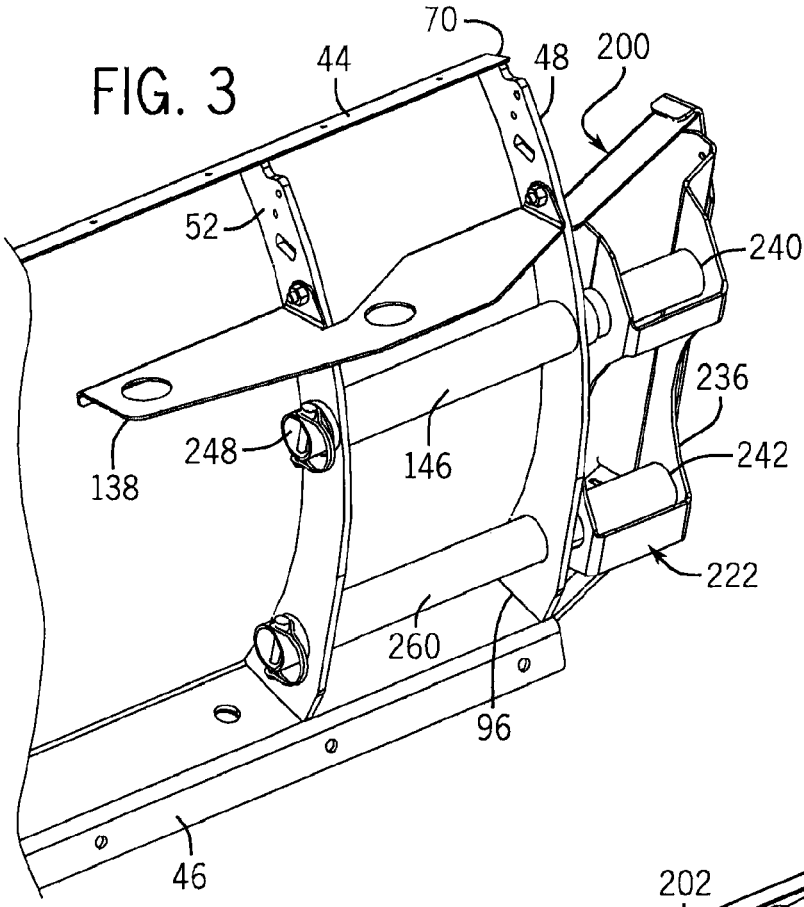
FIG. 3 is a partial view of the snow plow blade illustrated in FIGS. 1 and 2, showing the removable snow plow wing in the installed and operational position.
Figure 5:
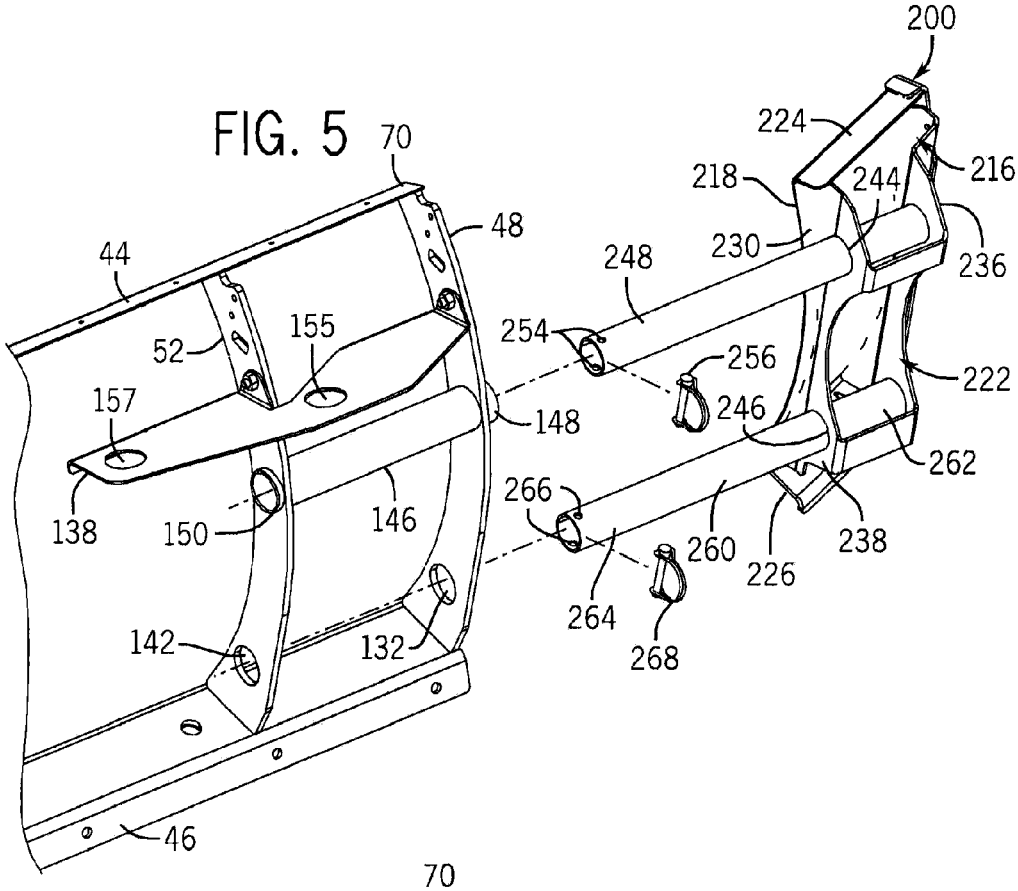
FIG. 5 is a partial, exploded view of the snow plow blade illustrated in FIGS. 1 through 4, showing assembly of the removable wing onto the frame of the snow plow blade.
Figure 6:
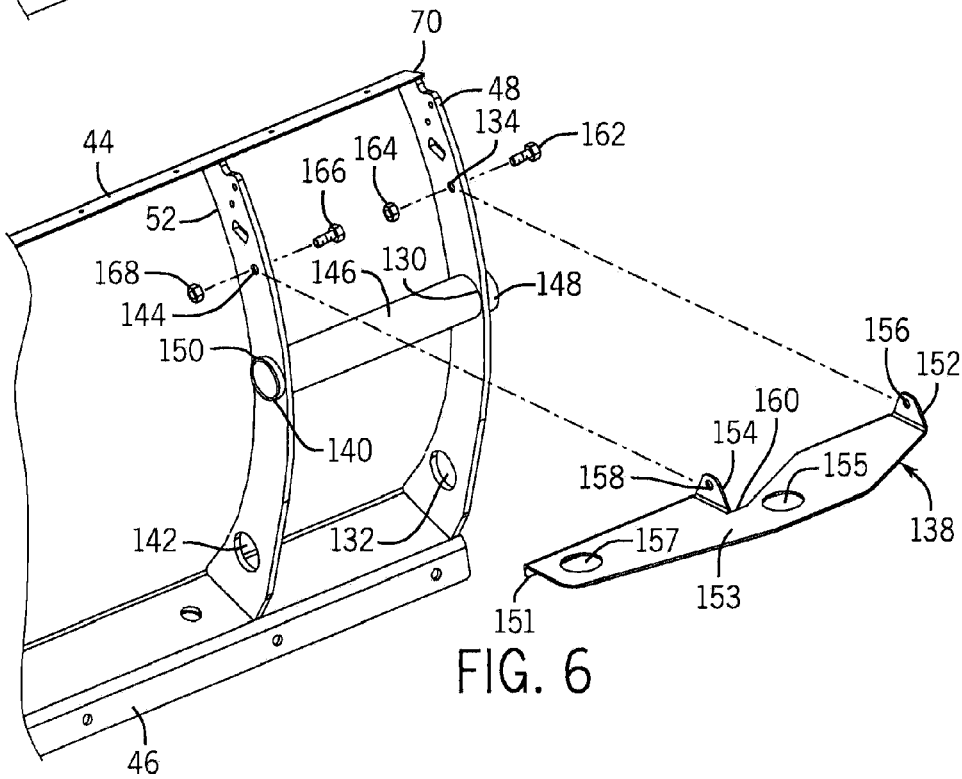
FIG. 6 is a partial, exploded view of the snow plow blade illustrated in FIGS. 1 through 5, showing assembly of the wing storage bracket onto the frame of the snow plow blade.

Turning now to FIGS. 3, 5 and 6, in addition to FIGS. 1 and 2, the vertical side member 48 of the support frame 40 includes upper and lower openings, indicated generally at 130 and 132. The openings 130 and 132 are preferably circular, but maybe formed in another shape, if desired. An aperture 134 is formed above the upper opening 130 on the vertical side member 48 to secure a wing storage bracket 138 thereto. The rib 52, adjacent to the vertical member 48, also includes upper and lower openings, indicated generally at 140 and 142. An aperture 144, substantially axially aligned with the aperture 134 on the vertical side member 48, is formed above the upper opening 140 on the rib 52 to secure the wing bracket 138 to the support frame 40.

As best illustrated in FIGS. 5 and 6, the upper openings 130 and 140 in the vertical side member 46 and the rib 52, respectively, are axially aligned with each other. Likewise, lower openings 132 and 142 in the vertical side member 46 and the rib 52, respectively, are also axially aligned with each other. The openings 130, 132, 140 and 142 can be formed in the vertical side member 48 and rib 52, respectively, by any means known to those skilled in the art, including provided in the vertical side member 48 and rib 52 after assembly of the support frame 40. As such, it will be appreciated that the present invention can be retrofitted on to already assembled snow plow blades and/or installed on to an existing snow plow blade after sale of the blade to a consumer.

A tube member 146 for supporting the wing extension 200 during operation of the snow plow extends through the upper opening 130 in the vertical side member 48 and through the upper opening 140 in the rib 52. An end 148 of the tube member 146 is secured to the vertical side member 48 and an end 150 of the tube member 146 is secured to the rib 52.

The wing bracket 138 is a plate-type member having a downwardly extending edge 151 that will abut the moldboard 42 when the bracket is installed on the snow plow blade 30, a flat portion 153 including two spaced apart openings, 155 and 157, and two upwardly extending tabs 152 and 154. The tab 152 is positioned on the bracket wing 138 so that it abut the inner face of the vertical side member 48. An aperture 156 is formed in the tab 152 and is positioned to axially align with the aperture 134 on the vertical side member 48. Likewise, the tab 154 is positioned on the wing bracket 138 so that it abut the inner face of the rib 52. An aperture 158 is formed in the tab 154 and is positioned to axially align with the aperture 144 on the rib 52. A notch 160 configured to accommodate the rib 52 can also be included in the wing bracket 138.

Figure 8:
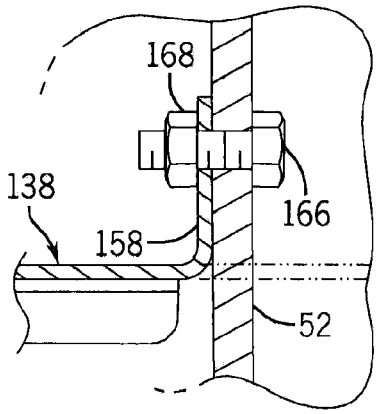
FIG. 8 is partial view of the wing bracket of the snow plow blade illustrated in FIGS. 1 through 7, taken along the line 8-8 in FIG. 7.

As best illustrated in FIG. 8, the wing bracket 138 is removably secured to the snow plow support frame 40 by threading a bolt 162 through the aperture 134 on the vertical side member 48 and then through the aperture 156 in the tab 152 and securing it with a nut 164. Likewise, a bolt 166 is threaded through the aperture 144 on the rib 52, through the aperture 158 in the tab 154 then it is secured with a nut 168.

Figure 9:
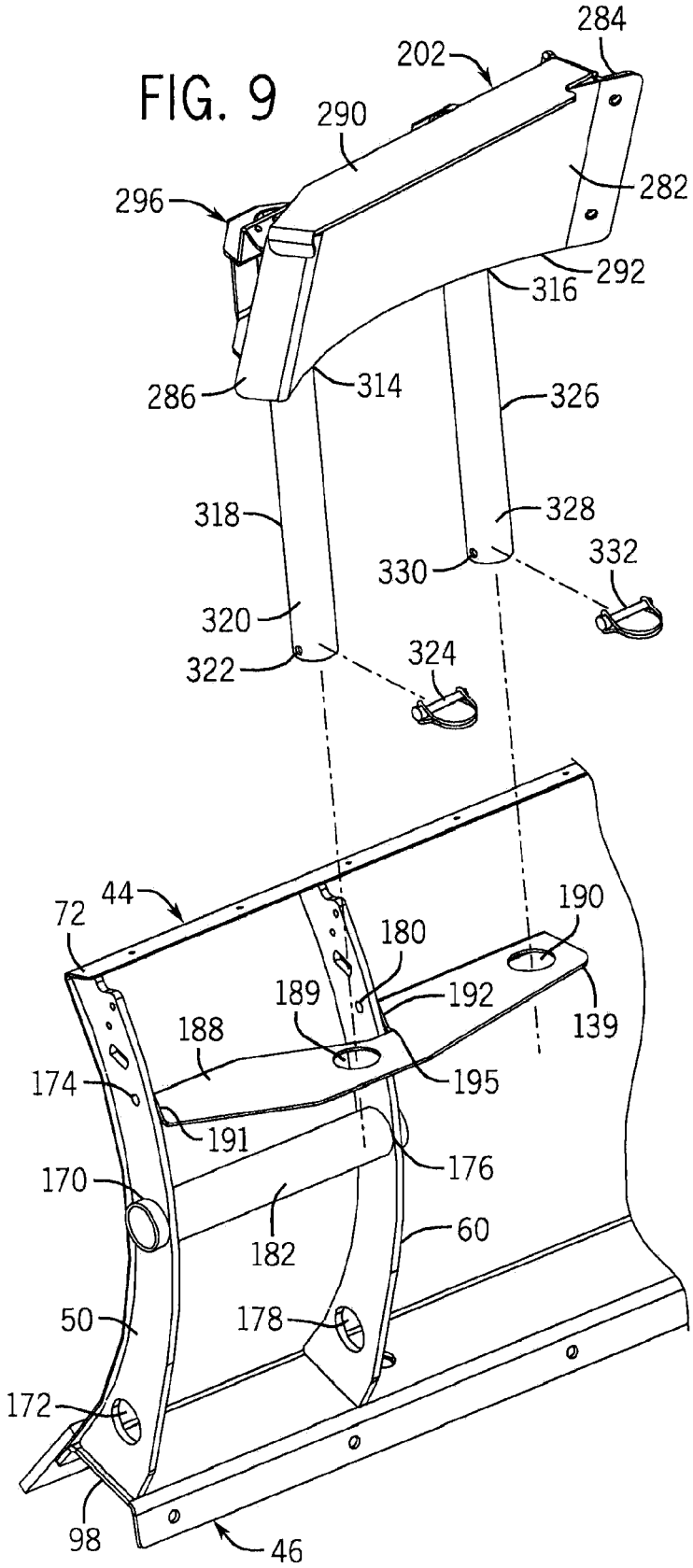
FIG. 9 is a partial exploded view of the snow plow blade having removable snow plow wings illustrated in FIGS. 1 through 8, showing installation of the wing into the storage bracket of the frame of the snow plow blade.

Turning now to FIG. 9, in addition to FIGS. 1 and 2, the vertical side member 50 of the support frame 40 includes upper and lower openings, indicated generally at 170 and 172. The openings 170 and 172 are preferably circular, but maybe formed in another shape, if desired. An aperture 174 is formed above the upper opening 170 on the vertical side member 50 to secure a wing bracket 139 thereto. The rib 60, adjacent to the vertical member 50, also includes upper and lower openings, indicated generally at 176 and 178. An aperture 180, substantially axially aligned with the aperture 174 on the vertical side member 50, is formed above the upper opening 176 on the rib 60 to secure the wing bracket 139 to the support frame 40.

As best illustrated in FIGS. 9, the upper openings 170 and 176 in the vertical side member 50 and the rib 60, respectively, are axially aligned with each other. Likewise, lower openings 172 and 178 in the vertical side member 50 and the rib 60, respectively, are also axially aligned with each other. The openings 170, 172, 176 and 178 can be formed in the vertical side member 50 and rib 60, respectively, by any means known to those skilled in the art. As such, it will be appreciated that the present invention can be retrofitted on to already assembled snow plow blades and/or installed on to an existing snow plow blade after sale of the blade to a consumer.

A tube member 182 for supporting the wing extension 202 during operation of the snow plow extends through the upper opening 170 in the vertical side member 50 and through the upper opening 176 in the rib 60. An end 170 of the tube member 182 is secured to the vertical side member 50 and an end 172 of the tube member 182 is secured to the rib 60.

The wing bracket 139 is a plate-type member having a downwardly extending edge 187 that will abut the moldboard 42 when the bracket is installed on the snow plow blade 30, a flat portion 188 including two spaced apart openings, 189 and 190, respectively, and two upwardly extending tabs 191 and 192. The tab 191 is positioned on the bracket wing 139 so that it will abut the inner face of the vertical side member 50. An aperture 193 (not shown) is formed in the tab 191 and is positioned to axially align with the aperture 174 on the vertical side member 50. Likewise, the tab 192 is positioned on the wing bracket 139 so that it will abut the inner face of the rib 60. An aperture 194 (not shown) is formed in the tab 192 and is positioned to axially align with the aperture 180 on the rib 60. A notch 195 configured to accommodate the rib 60 can also be included in the wing bracket 139.

Like the wing bracket 139, the wing bracket 139 is removably secured to the snow plow support frame 40 by threading a bolt through the aperture 174 on the vertical side member 50 and then through the aperture 193 in the tab 191 and securing it with a nut. Likewise, a second bolt is threaded through the aperture 180 on the rib 60 and then through the aperture 194 in the tab 192 and then it is secured with a nut.

Additional elements, such as brackets 201 for mounting the hydraulic operating system or blade tripping system (not shown), bars 203 for securing a lighting accessory (not shown), and/or other mounting plates for securing support shoes can be incorporated into the support frame 40, as will be appreciated by those skilled in the art.

To assemble the snow plow blade 30 of the present invention, the support frame 40 is permanently and securably assembled by welding or otherwise joining individual components as is well known to those skilled in the art. The top edge 45 of the moldboard 42 is secured to the top member 44 using the fastening mechanism 80, or by any means known to those skilled in the art. Consistent with the broader aspects of the present invention, the moldboard may be welded or otherwise permanently secured in place, depending on the end-use application of the plow.

Figure 21:
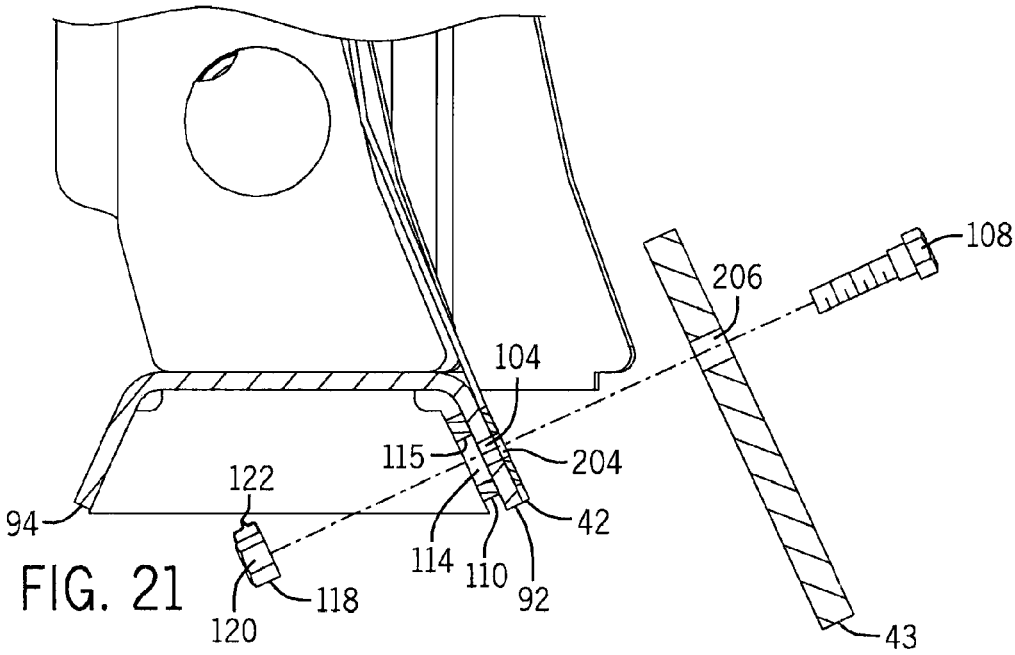
FIG. 21 is an exploded side view of the snow plow blade illustrated FIGS. 1 through 11, and 17 through 20, showing assembly of the wearstrip installed on to the snow plow frame.

As illustrated in FIGS. 20 and 21, apertures 204 are provided in near the bottom edge of the moldboard 42 and are formed in a substantially equally spaced manner along the length thereof. There are preferably ten apertures 204 in the moldboard 42, which are configured to align with the apertures 104 in the front leg 92 of the bottom member 46, and in turn, are configured to align with the apertures 114 in the nut plate 110. When the moldboard 42 is installed on the support frame 40, the apertures 204 in the bottom edge of the moldboard 42 should be in a properly aligned position.

Likewise, apertures 206 are also provided in the wearstrip 43, which are formed in a substantially equally spaced manner along the length thereof. There are preferably ten apertures 206 in the wearstrip 43, which are configured to align with the apertures 204 in the moldboard 42, the apertures 104 in the front leg 92 of the bottom member 46, and in turn, are configured to align with the aperture 114 in the nut plate 110.

Once the moldboard 42 is installed and properly positioned so that its apertures 204 are aligned with the apertures 104 in the bottom member 46, the wearstrip 43 is positioned adjacent to the moldboard 42 so that its apertures 206 are aligned with the apertures 204 in the moldboard 42. Each of the bolts 108 is then inserted consecutively through the aperture 206 in the wearstrip 43, the aperture 204 in the moldboard 42, the aperture 104 in the bottom member 46 and the aperture 104 in the nut plate 110. Each nut 118 is partially threaded by hand or otherwise on to the bolt 108 at least until the nut is partially positioned inside the aperture 104 in the nut plate 110.

Because the nut 118 cannot be turned or rotated inside the aperture 114 of the nut plate 110, the bolt 108 is tightened from the front plowing side 34 of the snow plow blade 30, without the problem of the nut 118 spinning, turning or coming loose, and without the need for a second individual to hold the nut 118 in place during installation and removal of the wearstrip 43. Accordingly, the wearstrip 43 is easily secured to the support frame 40 of the snow plow blade 30 from the front plowing side 34 thereof.

Figure 10:
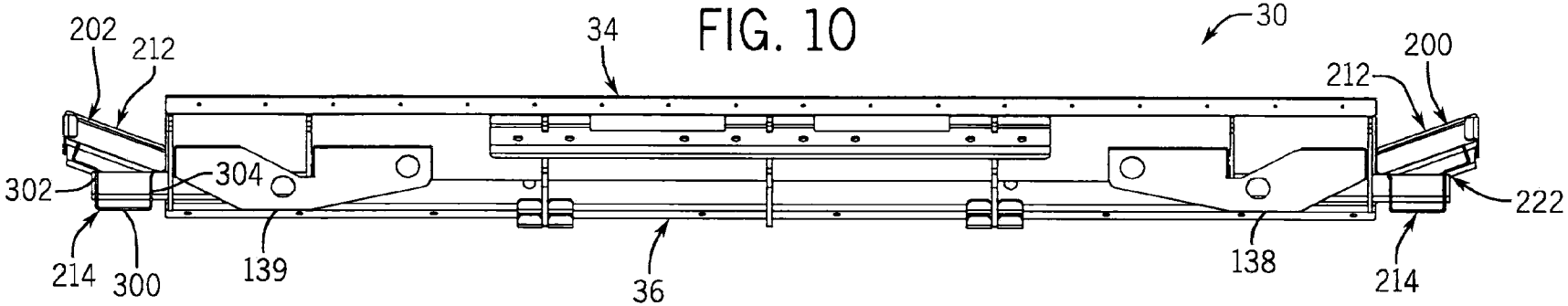
FIG. 10 is a top plan view of the snow plow blade illustrated in FIGS. 1 through 9.

Referring next to FIGS. 3 through 11, in addition to FIGS. 1 and 2, the removable snow plow wing extensions 200 and 202 will now be described. It will be appreciated that the wing extensions 200 and 202 are mirror images of each other, and are therefore constructed in substantially the same manner. As illustrated in FIG. 10, each of the wing extensions 200 and 202 have a forward plowing surface, indicated generally at 212, and a rearward attachment surface, indicated generally at 214.

The wing extension 200, in its simplest form, includes a wing frame 216, a moldboard section 218 secured to the front side of the wing frame 216 and a wing cutting edge or wearstrip 220 secured to a bottom edge of the moldboard section 218.

The wing frame 216 comprises a top member 224, provided, at least in part, to retain or secure the top edge of the moldboard section 218 in place, a bottom member 226 provided, at least in part to retain or secure the moldboard section 218 and the wearstrip 220 in place, substantially vertical side members 228 and 230, and an attachment mechanism, indicated generally at 222.

It will be appreciated that the wing frame components 216 are constructed of a metal material, like the blade support frame 40, and are preferably welded together or otherwise permanently secured in a conventional manner. Further, the moldboard section 218 and the wearstrip 220 can be constructed of a metal material such as rolled steel, stainless steel, carbon steel or another metal composite or alloy material, as well known to those skilled in the art. Further, the moldboard 218 and/or wearstrip 220 may be constructed of a thermoplastic material, such as polycarbonate or polyurethane, or most preferably, can be constructed of a metal material coated or covered in a thermoplastic material.

Figure 11:
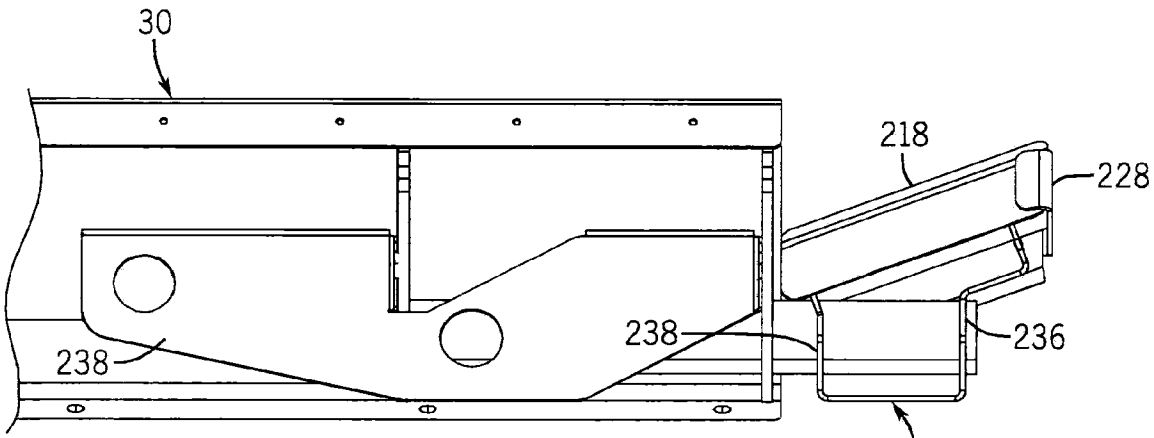
FIG. 11 is partial view of the snow plow blade illustrated in FIGS. 1 through 10, showing the wing and bracket in the installed position.
Figure 14:
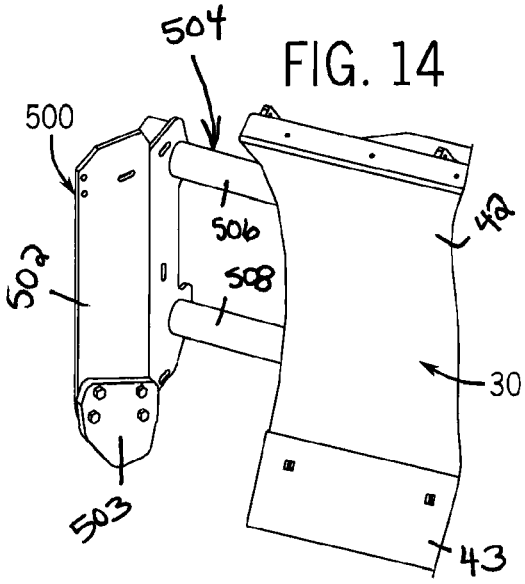
FIG. 14 is partial view of a snow plow blade of the present invention, shown with a third embodiment of a removable snow plow wing constructed in accordance with the present invention.

The attachment mechanism 222 comprises an attachment bracket 234 having a first side end 236 secured to the vertical side member 228 of the wing frame 216 and a second side end 238 secured to the vertical side member 230 of the wing frame 216, providing a means for attaching the wing extension 200 to the snow plow blade 30. As best illustrated in FIGS. 10 and 11, the first side end 235 of the attachment bracket 234 is longer than the second side end 238 of the bracket 234. This permits the wing extension 200 to be angled forward with respect to the snow plow blade, providing additional plowing capacity to the snow plow blade 30 but also allows the attachment mechanism 22 of the wing 200 to be substantially axially aligned with the snow plow blade frame components.

Figure 7:
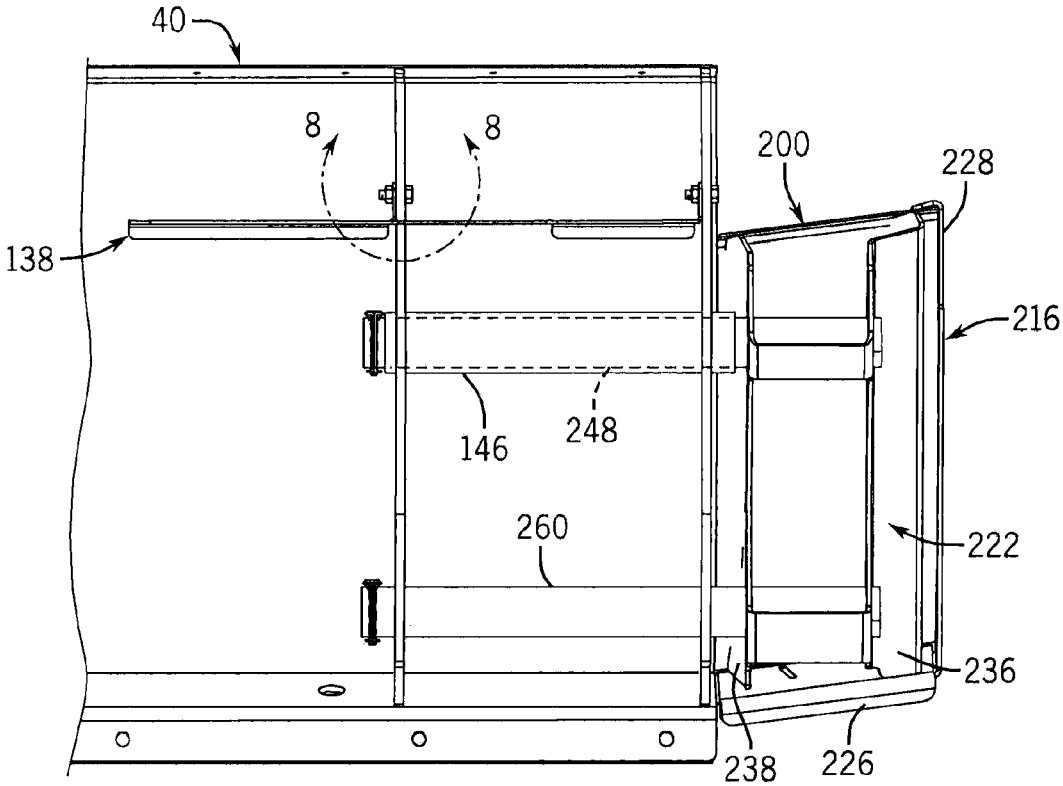
FIG. 7 is a partial, rear plan view of the snow plow blade illustrated in FIGS. 1 through 6, showing the wing storage bracket and the removable wing installed onto the frame of the snow plow blade.

Upper openings 240 and 244 and lower openings 242 and 246 are provided in each of the first and second side ends 236 and 238, respectively, of the attachment bracket 234. As best illustrated in FIGS. 5 and 7, the upper opening 240 in the first side end 236 and the upper opening 244 in the second side end 238 of the attachment bracket 234 are axially aligned with each other. Likewise, lower opening 242 in the first side end 236 and the lower opening 246 in the second side end 238 of the attachment bracket 234 are axially aligned with each other.

Attachment arm 248 extends through the upper openings 240 and 244 in the attachment bracket 234. An end 250 thereof is permanently secured to the first side end 236 of the attachment bracket 234. The attachment arm 248 extends through the upper opening 244 in the second side end 238 of the attachment bracket and is secured thereto. A second end 252 of the attachment arm 248 extends away from the second side end 238 of the attachment bracket 234. As illustrated in FIGS. 10 and 11, the attachment arm 248 is oriented substantially straight when assembled with the bracket 236. The end 252 of the attachment arm 248 includes a pair of apertures 254 for securing the wing extension 200 in position on the snow plow blade 30 with a pin 256 or other locking mechanism. It will be appreciated that the attachment arm 248 is preferably tubular and configured to fit inside the tube member 146 on the wing frame 40.

Likewise, attachment arm 260 extends through the lower openings 242 and 246 in the attachment bracket 234. An end 262 thereof is permanently secured to the first side end 236 of the attachment bracket 234. The attachment arm 260 extends through the lower opening 246 in the second side end 238 of the attachment bracket 234 and is secured thereto. A second end 264 of the attachment arm 260 extends away from the second side end 238 of the attachment bracket 234. As illustrated in FIGS. 10 and 11, the attachment arm 260 is oriented substantially straight when assembled with the bracket 236. The end 264 of the attachment arm 260 includes a pair of apertures 266 for securing the wing extension 200 in position on the snow plow blade 30 with a pin 268 or other locking mechanism. It will be appreciated that the attachment arm 260 is preferably tubular and configured to fit inside each of the lower openings 132 and 142 on the wing frame 40.

The wing extension 202, in its simplest form, includes a wing frame 280, a moldboard section 282 secured to the front side of the wing frame 280 and a wing cutting edge or wearstrip 284 secured to a bottom edge of the moldboard section 280.

The wing frame 280 comprises a top member 286, provided, at least in part, to retain or secure the top edge of the moldboard section 282 in place, a bottom member 288 provided, at least in part to retain or secure the moldboard section 282 and the wearstrip 284 in place, vertical side members 290 and 292, and an attachment mechanism, indicated generally at 296. It will be appreciated that the wing frame components 280 are constructed of a metal material, like the wing frame components 280, and are preferably welded together or otherwise permanently secured in a conventional manner. Further, the moldboard section 282 and the wearstrip 284 can be constructed of a metal material such as rolled steel, stainless steel, carbon steel or another metal composite or alloy material, as well known to those skilled in the art. Further, the moldboard 282 and/or wearstrip 284 may be constructed of a thermoplastic material, such as polycarbonate or polyurethane, or most preferably, can be constructed of a metal material coated or covered in a thermoplastic material.

The attachment mechanism 296 includes an attachment bracket 300, configured in a mirror image manner to the attachment bracket 234, having a first side end 302 secured to the vertical side member 290 of the wing frame 280 and a second side end 304 secured to the vertical side member 292 of the wing frame 280, providing a means for attaching the wing extension 202 to the snow plow blade 30. As best illustrated in FIG. 10, the first side end 302 of the attachment bracket 230 is longer than the second side end 304 of the bracket 300. This permits the wing extension 202 to be angled forward with respect to the snow plow blade 30, providing addition plowing capacity to the snow plow blade 30.

Upper openings 310 and 314 and lower openings 312 and 316 are provided in each of the first and second side ends 302 and 304, respectively, of the attachment bracket 300. As best illustrated in FIGS. 1, 2, 4 and 9, the upper opening 310 in the first side end 302 and the upper opening 314 in the second side end 304 of the attachment bracket 300 are axially aligned with each other. Likewise, lower opening 312 in the first side end 302 and the lower opening 316 in the second side end 304 of the attachment bracket 300 are axially aligned with each other.

Attachment arm 318 extends through the upper openings 240 and 244 in the attachment bracket 300. An end of the attachment arm 318 is permanently secured to the first side end 302 of the attachment bracket 300. The attachment arm 318 extends through the upper opening 314 in the second side end 304 of the attachment bracket 300 and is secured thereto. A second end 320 of the attachment arm 318 extends away from the second side end 304 of the attachment bracket 300. As illustrated in FIG. 10, the attachment arm 318 is oriented substantially straight when assembled with the bracket 300. The end 320 of the attachment arm 318 includes a pair of apertures 322 for securing the wing extension 202 in position on the snow plow blade 30 with a pin 324 or other locking mechanism. It will be appreciated that the attachment arm 318 is preferably tubular and configured to fit inside the tube member 182 on the wing frame 40.

Likewise, an attachment arm 326 extends through the lower openings 312 and 316 in the attachment bracket 300. An end of the attachment arm 326 is permanently secured to the first side end 302 of the attachment bracket 300. The attachment arm 326 extends through the lower opening 316 in the second side end 304 of the attachment bracket 300 and is secured thereto. A second end 328 of the attachment arm 326 extends away from the second side end 304 of the attachment bracket 300. As illustrated in FIG. 10, the attachment arm 328 is oriented substantially straight when assembled with the bracket 300. The end 328 of the attachment arm 326 includes a pair of apertures 230 for securing the wing extension 202 in position on the snow plow blade 30 with a pin 332 or other locking mechanism. It will be appreciated that the attachment arm 326 is preferably tubular and configured to fit inside each of the lower openings 178 and 172 on the wing frame 40.

The wing extensions 200 and 202 are easily installed on the snow plow blade 30. As illustrated in FIGS. 5 and 7, the wing 200 is positioned so the upper attachment arm 248 is substantially aligned with the tube 146 in the support frame 40, and the lower attachment arm 260 is substantially aligned with the lower openings 132 and 142 of the support frame 40. The attachment arms 248 and 260 of the wing extension 200 are then inserted into the tube 146, and lower openings 132 and 142, respectively, until there is substantially no gap or space between the snow plow blade 30 and the wing extension 200, providing a contiguous plowing surface in which to contact and move the snow or other materials. The pin 256 is the inserted into the apertures 254 on the arm 248 and secured, locking the arm 248 into position on the snow plow blade 30. Likewise, the pin 268 is inserted into the apertures 254 on the arm 260 and secured, locking the arm 260 into position on the snow plow blade 30.

When the wing extension 200 is not needed, it can be secured to the snow plow blade 30 in a stored position using the wing storage bracket 138. From the operational position, the pins 256 and 268 are removed from the apertures, 254 and 266, respectively, on the wing attachment arms 248 and 260. The wing extension 200 removed from the side of the snow plow blade and flipped over so that the moldboard section 218 is facing the rear side 36 of the snow plow blade 30. The wing 200 is rotated so that the arms 248 and 260 align with the openings 157 and 155 in the bracket 138, respectively. The arms 248 and 260 are then inserted into the openings 157 and 155 in the bracket 138 and the pins 256 and 268 are inserted into the apertures, 254 and 266, respectively, locking the wing 200 into the stored position.

Figure 4:
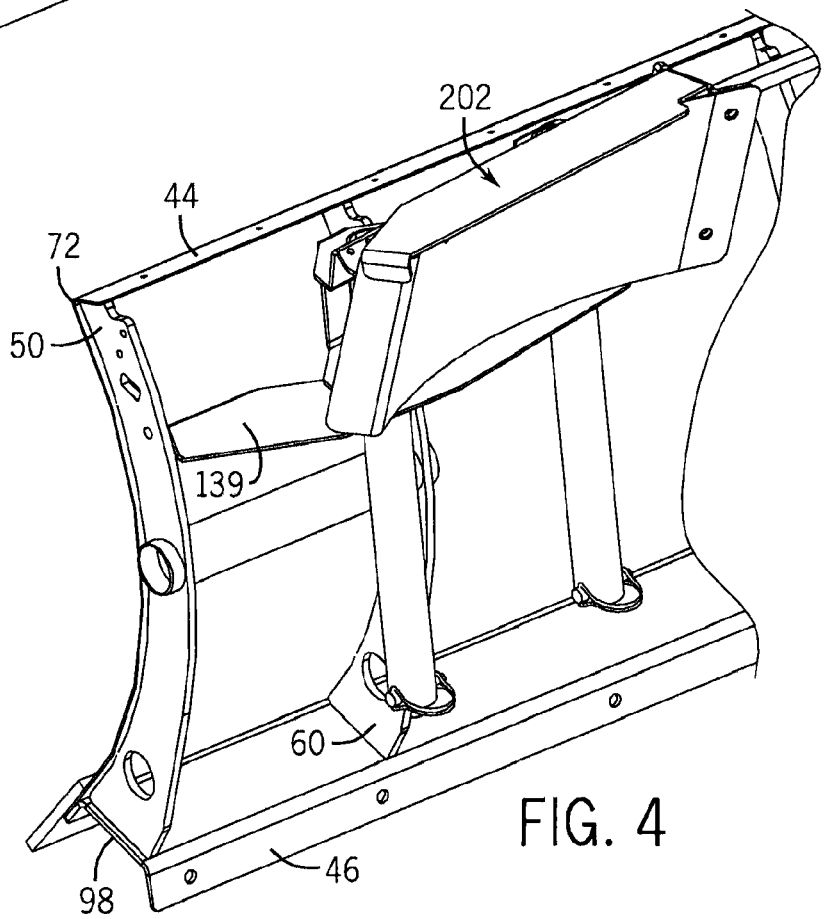
FIG. 4 is partial view of the snow plow blade illustrated in FIGS. 1 through 3, showing the wing in the stored position.

As illustrated in FIGS. 4, 9 and 10, the wing 202 is installed in the same manner as the wing 200. Accordingly, the wing 202 is positioned so the upper attachment arm 318 is substantially aligned with the tube 182 in the support frame 40, and the lower attachment arm 326 is substantially aligned with the lower openings 172 and 178 of the support frame 40. The attachment arms 318 and 326 of the wing extension 202 are then inserted into the tube 182, and lower openings 172 and 178, respectively, until there is substantially no gap or space between the snow plow blade 30 and the wing extension 202, providing a contiguous plowing surface in which to contact and move the snow or other materials. The pin 324 is the inserted into the apertures 322 on the arm 318 and secured, locking the arm 318 into position on the snow plow blade 30. Likewise, the pin 332 is the inserted into the apertures 330 on the arm 326 and secured, locking the arm 326 into position on the snow plow blade 30.

When the wing extension 202 is not needed, it can be secured to the snow plow blade 30 in a stored position using the wing storage bracket 139. From the operational position, the pins 324 and 332 are removed from the apertures, 322 and 330, respectively, on the wing attachment arms 318 and 326. The wing extension 202 is removed from the side of the snow plow blade 30 and flipped over so that the moldboard section 282 is facing the rear side 36 of the snow plow blade 30. The wing 202 is rotated so that the arms 318 and 326 align with the openings 189 and 190 in the bracket 139, respectively. The arms 318 and 326 are then inserted into the openings 189 and 190 in the bracket 139 and the pins 324 and 332 are inserted into the apertures, 322 and 330, respectively, locking the wing 202 into the stored position.

Figure 16:
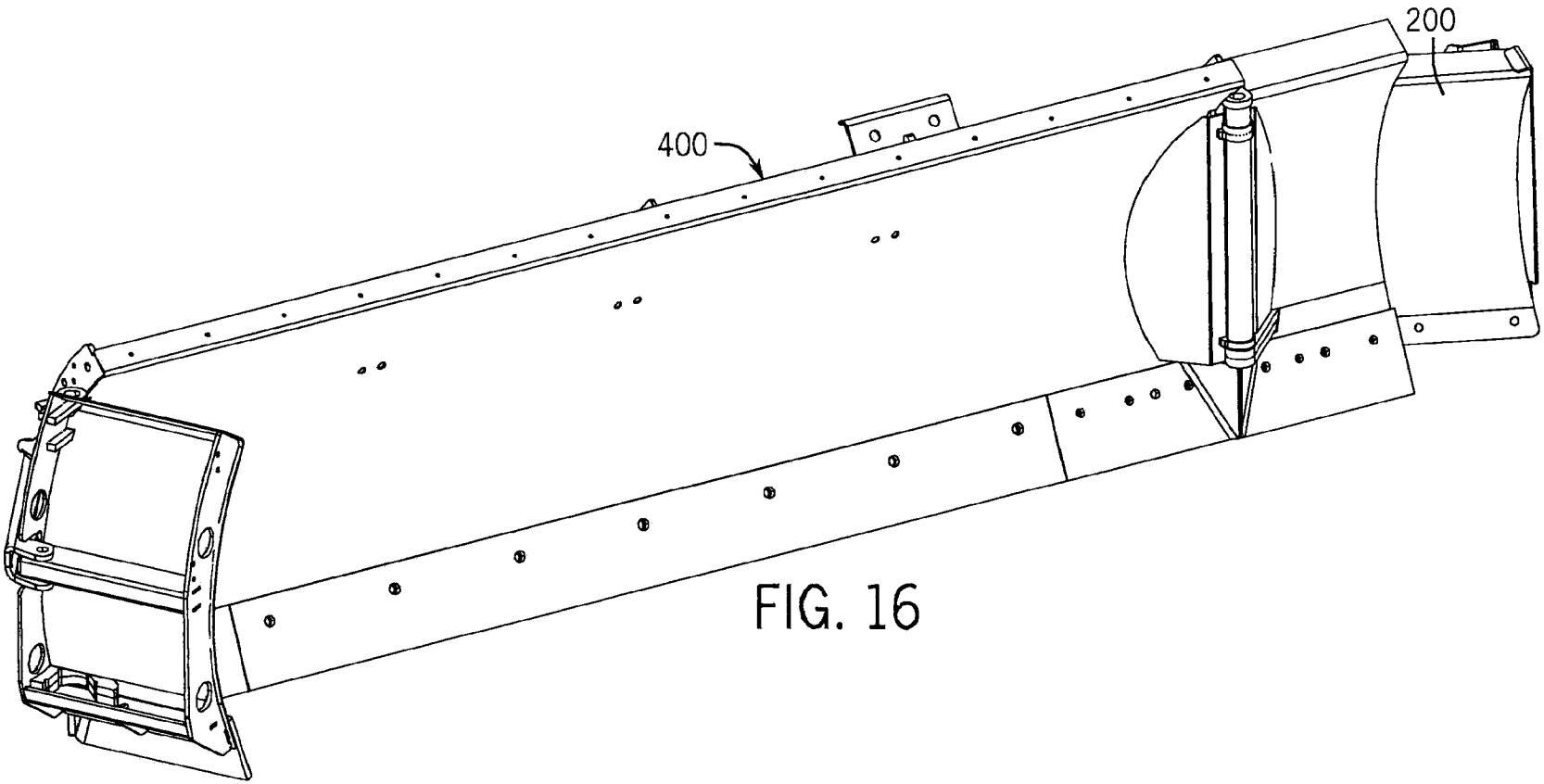
FIG. 16 is front perspective view of an articulated snow plow configuration including the removable snow plow wings constructed in accordance with the present invention.
Figure 17:
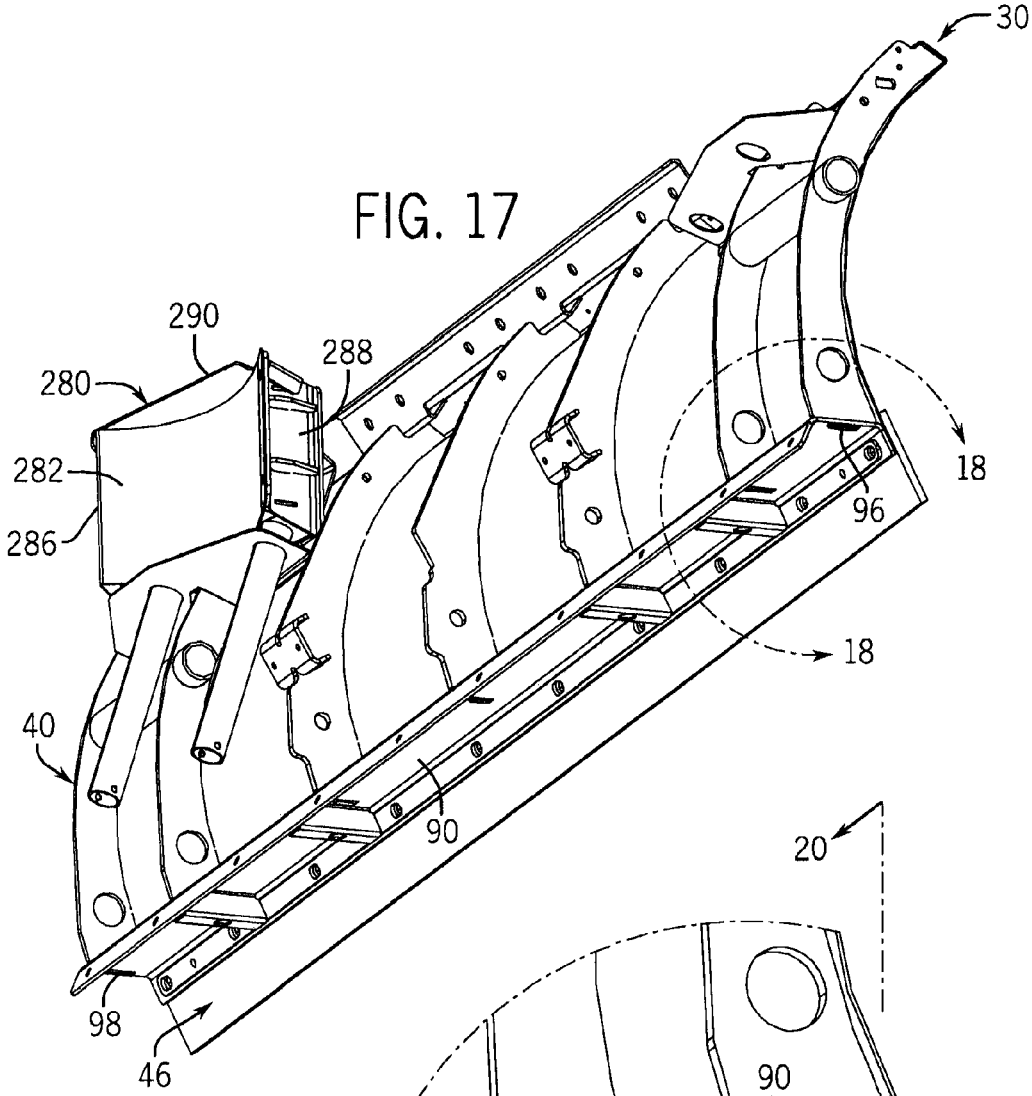
FIG. 17 is bottom perspective view of the snow plow blade illustrated in FIGS. 1 through 11, showing a support frame including a nut retaining plate constructed in accordance with the present invention.

It will be appreciated that the snow plow wing extensions 200 and 202 can be used at the same time during operation of the snow plow, or only one of the wing extensions 200 or 202 can be used for a given application, while the other wing is stored, depending on the given plowing application. As illustrated in FIG. 16, and consistent with the broader aspects of the present invention, the snow plow wing extensions of the present invention can be secured to an articulated plowing system, wherein one of the wing extensions is secured to one of the articulated wings 402 of the main snow plow blade 400, and wherein the other one of the wing extensions 202 is secured and/or stored within the other of the articulated wings 404 of the main snow plow blade 400.

Figure 12:
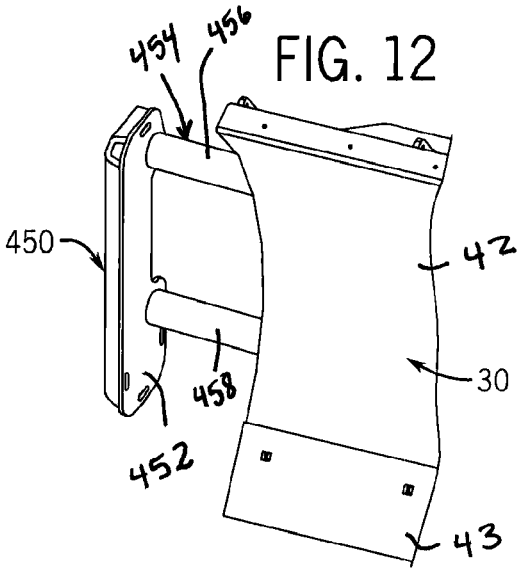
FIG. 12 is partial view of a snow plow blade of the present invention, shown with a second embodiment of a removable snow plow wing constructed in accordance with the present invention.
Figure 15:
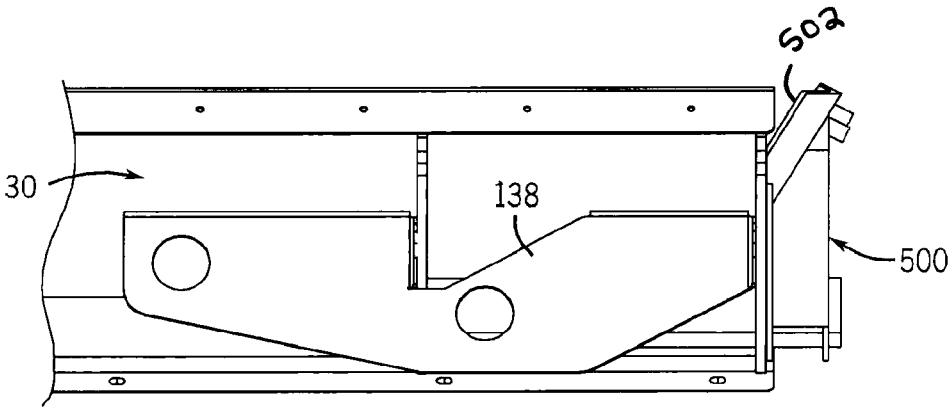
FIG. 15 is top view of the snow plow blade and removable snow plow wing illustrated in FIG. 14.
Figure 13:
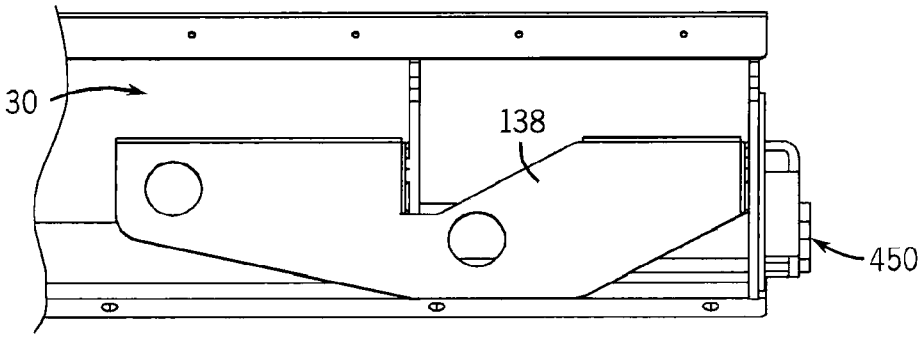
FIG. 13 is top view of the snow plow blade and removable snow plow wing illustrated in FIG. 12.

Turning next to FIGS. 12 through 15, additional embodiments of the wing extension components are illustrated. Referring first to FIGS. 12 and 13, a curb and edge guard wing extension 450 is illustrated. The wing extension 450 includes a substantially planar portion 452 that is configured to abut and protect the moldboard 42 when the wing extension 450 is installed on to the snow plow blade 30. The wing extension 450 is oriented in a generally linear fashion with respect to the snow plow blade 30 to protect the blade components from impact with curbs and other road debris.

The wing extension 450 includes an attachment mechanism 454 configured in like manner to the attachment mechanism 222 of the wing extension 200. As such, the wing 450 includes an upper attachment arm 456 that is substantially aligned with the tube 146 in the support frame 40, and the lower attachment arm 458 that is substantially aligned with the lower openings 132 and 142 of the support frame 40. The attachment arms 456 and 458 of the wing extension 450 are then inserted into the tube 146, and lower openings 132 and 142, respectively, until there is substantially no gap or space between the snow plow blade 30 and the wing extension 450, providing a contiguous plowing surface in which to contact and move the snow or other materials. Removable pins, similar to pins 256 and 268, secure the ends of the attachment arms 456 and 458 into place on the snow plow blade frame 40, locking the wing in place on the snow plow blade 30. If the wing 450 is not needed for a given application, it can be stored in the wing storage bracket 138, as will be appreciated by those skilled in the art.

The wing extension 500 includes a slightly angled portion 502 having a small section of wearstrip 503 secured thereto, to form a box-type shape when the wing extension 500 is installed on to the snow plow blade 30. The wing extension 500 includes an attachment mechanism 504 configured in like manner to the attachment mechanism 222 of the wing extension 200. As such, the wing 450 includes an upper attachment arm 506 that is substantially aligned with the tube 146 in the support frame 40, and the lower attachment arm 508 that is substantially aligned with the lower openings 132 and 142 of the support frame 40. The attachment arms 506 and 508 of the wing extension 500 are then inserted into the tube 146, and lower openings 132 and 142, respectively, until there is substantially no gap or space between the snow plow blade 30 and the wing extension 500, providing a contiguous plowing surface in which to contact and move the snow or other materials. Removable pins, similar to pins 256 and 268, secure the ends of the attachment arms 506 and 508 into place on the snow plow blade frame 40, locking the wing in place on the snow plow blade 30. If the wing 500 is not needed for a given application, it can be stored in the wing storage bracket 138, as will be appreciated by those skilled in the art.

Accordingly, the removable and storable wing extensions of the present invention are not limited to the size, shape and configuration illustrated; rather, any size, shape and angle of wing extension, relative to the main snow plow blade, can be configured to fit within the attachment mechanism disclosed by the present invention, and stored in the wing mounting bracket of the present invention.

The snow plow blade and wing extensions of the present invention are of a construction which is both durable and long lasting, and which will require little or no maintenance to be provided by the user throughout its operating lifetime. The snow plow blade and wing extensions are also of inexpensive construction to enhance its market appeal and to thereby afford it the broadest possible market. Finally, all of the aforesaid advantages and objectives of the snow plow blade and wing extensions of the present invention are achieved without incurring any substantial relative disadvantage.

Although the foregoing description of the snow plow blade and wing extensions of the present invention have been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A snow removal system for use with a snow plow vehicle, the snow removal system comprising:

a snow plow blade including a front plowing side, a rear attachment side, and substantially vertical first and second side ends;

a first wing storage bracket secured to the rear attachment side of the snow plow blade adjacent the first side end thereof;

a second wing storage bracket secured to the rear attachment side of the snow plow blade adjacent the second side end thereof;

a first removable wing having a front plowing surface and a rear attachment mechanism, the first removable wing configurable between an operational position, wherein the rear attachment mechanism of the first removable wing is secured the rear attachment side of the snow plow blade adjacent the first side end thereof such that the front plowing surface of the first removable wing and the front plowing side of the snow plow blade an extended snow removal surface for the snow plow system, and a second stored position, wherein the rear attachment mechanism of the first removable wing is mounted to the first wing storage bracket on the rear attachment side of the snow plow blade; and a second removable wing having a front plowing surface and a rear attachment mechanism, the second removable wing configurable between an operational position, wherein the rear attachment mechanism of the second removable wing is secured the rear attachment side of the snow plow blade adjacent the second side end thereof such that the front plowing surface of the second removable wing and the front plowing side of the snow plow blade provide an extended snow removal surface for the snow plow system, and a second stored position, wherein the rear attachment mechanism of the second removable wing is mounted to the second wing storage bracket on the rear attachment side of the snow plow blade.

2. The snow removal system of claim 1, wherein the front plowing side of the snow plow blade comprises a moldboard, a wearstrip or a combination thereof.

3. The snow removal system of claim 1, wherein the rear attachment side of the snow plow blade comprises a plurality of vertically oriented ribs spaced apart between the first and second vertical side ends thereof, wherein the first side end and the rib adjacent to the first side end includes at least one opening configured to receive the attachment mechanism of the first removable wing and wherein the second side end and the rib adjacent to the second side end includes at least one opening configured to receive the attachment mechanism of the second removable wing.

4. The snow removal system of claim 3, wherein each of the first and second wing brackets each a substantially planar, horizontally oriented surface with at least one opening formed therein.

5. The snow removal system of claim 4, wherein the attachment mechanism of the first removable wing includes a bracket secured to the front plowing side thereof and at least one tube member having a first end secured to the bracket and a second end configured to fit within the at least one opening of the first vertical member and the adjacent rib, and configured to fit within the at least one opening of the first wing storage bracket.

6. The snow removal system of claim 5, wherein the second end of the tube member of the first wing includes a removable pin.

7. The snow removal system of claim 6, wherein the second end of the tubular member of the first removable wing is inserted through the at least one opening of the first vertical side end and through the opening in the next adjacent rib and secured in place with the pin when the first removable wing is in the operational position.

8. The snow removal system of claim 6, wherein the second end of the tubular member of the first removable wing is inserted within the at least one opening of the first wing storage bracket secured in place with the pin when the first removable wing is in the stored position.

9. The snow removal system of claim 4, wherein the attachment mechanism of the second removable wing includes a bracket secured to the front plowing side thereof and at least one tube member having a first end secured to the bracket and a second end configured to fit within the at least one opening of the second vertical member and the next adjacent rib, and configured to fit within the at least one opening of the second wing storage bracket.

10. The snow removal system of claim 9, wherein the second end of the tube member of the second wing includes a removable pin.

11. The snow removal system of claim 10, wherein the second end of the tubular member of the second removable wing is inserted through the at least one opening of the second vertical side end and through the opening in the next adjacent rib and secured in place with the pin when the second removable wing is in the operational position.

12. The snow removal system of claim 10, wherein the second end of the tubular member of the second removable wing is inserted through the at least one opening of the second wing storage bracket secured in place with the pin when the second removable wing is in the stored position.

13. The snow removal system of claim 1, wherein the first and second removable wings are both secured in the operational position.

14. The snow removal system of claim 1, wherein the first removable wing is secured in the operational position and the second removable wing is secured in the stored position.

15. A snow plow blade include a front plowing surface and a rear surface configured to mount to a snow plow vehicle, the snow plow blade comprising:

a support frame including a top horizontal member having first and second ends, a bottom horizontal member having first and second ends, a first vertical portion connecting the top horizontal member to the bottom horizontal member at the first ends thereof, respectively, a second vertical portion connecting the top horizontal member to the bottom horizontal member at the second ends thereof, respectively;

a plurality of ribs space apart between the first and second vertical portions, the each of the ribs vertically connecting the top member and the bottom member, wherein the first vertical portion and the rib positioned next adjacent thereto each include at least one aperture formed therein, the aperture of the first vertical portion axially aligned with the aperture of the rib positioned next adjacent thereto, and wherein the second vertical portion and the rib positioned next adjacent thereto each include at least one aperture, the aperture of the second vertical portion axially aligned with the aperture of the rib positioned next adjacent thereto;

first and second storage brackets, the first storage bracket secured to the rear surface of the snow plow blade near the first vertical side portion of the frame, the second storage bracket secured to the rear surface of the snow plow blade near the second vertical side portion of the frame, wherein each of the first and second storage brackets include a substantially planar, horizontally oriented surface with at least one opening formed therein; and at least one removable wing including a plowing portion and a tubular attachment mechanism having a first end secured to the plowing portion and a second end, wherein the second end of the tubular attachment mechanism is configured to fit within the aperture of the first vertical portion and the aperture of the rib positioned next adjacent thereto when the wing is in the plowing position and wherein the tubular attachment mechanism is configured to fit within the opening of the first storage bracket when the wing is in the stored position.

16. The snow removal system of claim 15, wherein the plowing side of the removable wing is positioned close adjacent to and disposed at an forward angle with respect to the plowing surface of the snow plow blade.

17. The snow removal system of claim 15, wherein the second end of the tubular attachment mechanism is secured to the snow plow frame in the plowing position and the stored position with a removable pin.

18. A snow plow blade having an overall plowing width, the snow plow blade comprising:

a frame having a front side including a moldboard, a rear side configured to mount to a plowing vehicle and first and second opposing vertical side portions, the first and second opposing vertical side portions each defining an aperture therein;

a first storage bracket, the first storage bracket secured to the rear side of the frame near the first vertical side portion of the frame, wherein the first storage bracket includes a substantially planar, horizontally oriented surface with at least one opening formed therein; and an end extension comprising a plowing portion and a tubular mounting portion, the mounting portion having a first end secured to the plowing portion and a second end configured to fit through the aperture of the first vertical side portion of the frame to provide a contiguous material contact surface when the end extension is in the plowing position and wherein the tubular attachment mechanism is configured to fit within the opening of the first storage bracket when the end extension is in the stored position.

19. The snow plow blade of claim 18, further comprising:

a second storage bracket secured to the rear surface of the snow plow blade near the second vertical side portion of the frame; and a second end extension including a plowing portion and a tubular mounting portion, the mounting portion having a first end secured to the plowing portion and a second end configured to fit through the aperture of the second vertical portion to provide a contiguous material contact surface when the end extension is in the plowing position and wherein the tubular attachment mechanism is configured to fit within the opening of the second storage bracket when the end extension is in the stored position.

* * * * *